US010136220B2

(12) United States Patent
Son et al.

(10) Patent No.: US 10,136,220 B2
(45) Date of Patent: Nov. 20, 2018

(54) BLUETOOTH NECK BAND HEADSET INCLUDING VIBRATION SPEAKER

(71) Applicant: BLUECOM CO., LTD., Incheon (KR)

(72) Inventors: Kwangho Son, Incheon (KR); Jeong Il Kwon, Bucheon-si (KR); Sangyoon Shin, Incehon (KR); Leesub Song, Incheon (KR); Chungyul Ryu, Bucheon-si (KR)

(73) Assignee: BLUECOM CO., LTD., Incheon (KR)

( * ) Notice: Subject to any disclaimer, the term of this patent is extended or adjusted under 35 U.S.C. 154(b) by 0 days.

(21) Appl. No.: 15/455,334

(22) Filed: Mar. 10, 2017

(65) Prior Publication Data

US 2017/0295431 A1 Oct. 12, 2017

(30) Foreign Application Priority Data

Apr. 8, 2016 (KR) ..... 10-2016-0043162
Apr. 18, 2016 (KR) ..... 10-2016-0046671

(51) Int. Cl.
*H04R 25/00* (2006.01)
*H04R 5/033* (2006.01)
(Continued)

(52) U.S. Cl.
CPC ..... *H04R 5/0335* (2013.01); *H04R 1/105* (2013.01); *H04R 1/1016* (2013.01); *H04R 1/1041* (2013.01); *H04R 1/1075* (2013.01); *H04R 31/006* (2013.01); *H04R 2400/01* (2013.01); *H04R 2400/03* (2013.01); *H04R 2420/07* (2013.01); *H04R 2430/01* (2013.01); *H04R 2460/13* (2013.01)

(58) Field of Classification Search
CPC .. H04R 5/0335; H04R 1/1016; H04R 1/1041; H04R 1/105; H04R 1/1075; H04R 31/006; H04R 2400/01; H04R 2400/03; H04R 2420/07; H04R 2430/01; H04R 2460/13
USPC ..... 381/396
See application file for complete search history.

(56) References Cited

U.S. PATENT DOCUMENTS 3,892,289 A 7/1975 Rollins
6,091,832 A * 7/2000 Shurman ..... G02C 11/06 2/422

(Continued)

FOREIGN PATENT DOCUMENTS

KR 20-0295326 Y1 12/2002
KR 10-1040310 B1 6/2011

(Continued)

*Primary Examiner* — Tuan D Nguyen
(74) *Attorney, Agent, or Firm* — Rabin & Berdo, P.C.

(57) ABSTRACT

A Bluetooth neck band headset comprises a tube frame maintaining a shape of the neck band, base frames provided on both sides of the tube frame, a Bluetooth module provided in the base frame and performing two-way data communication by interworking with the terminal of the user, a vibration speaker provided on one surface of each base frame, an earphone coupled to one side of each base frame and outputting sound, a control module controlling any one or more of the vibration speaker, the earphone and the Bluetooth module, a power button provided on one surface of the base frame, and a volume button controlling the intensity of sound output of any one or more of the earphone and the vibration speaker.

6 Claims, 4 Drawing Sheets

(51) Int. Cl.
*H04R 1/10* (2006.01)
*H04R 31/00* (2006.01)

(56) References Cited

U.S. PATENT DOCUMENTS

| | | | | |
|---|---|---|---|---|
| 6,603,863 | B1 | 8/2003 | Nagayoshi | |
| 7,505,603 | B2 | 3/2009 | Yoo | |
| 9,445,175 | B2 | 9/2016 | Seo et al. | |
| 9,538,291 | B2 | 1/2017 | Yoon | |
| 2004/0188175 | A1* | 9/2004 | Sahyoun | H04R 7/122 181/157 |
| 2005/0180590 | A1* | 8/2005 | Proni | H04R 9/043 381/396 |
| 2006/0256996 | A1* | 11/2006 | Baeten | H04R 7/12 381/395 |
| 2007/0125591 | A1 | 6/2007 | Sahyoun | |
| 2007/0164616 | A1* | 7/2007 | Kuwabara | B06B 1/045 310/15 |
| 2009/0060250 | A1* | 3/2009 | Proni | H04R 9/025 381/396 |
| 2013/0195311 | A1* | 8/2013 | Sahyoun | H04R 1/2834 381/395 |
| 2016/0021449 | A1* | 1/2016 | Litovsky | H04R 1/105 381/374 |

FOREIGN PATENT DOCUMENTS

| | | | |
|---|---|---|---|
| KR | 10-1258293 | B1 | 4/2013 |
| KR | 10-2016-0034003 | A | 3/2016 |

* cited by examiner

BLUETOOTH NECK BAND HEADSET INCLUDING VIBRATION SPEAKER

BACKGROUND OF THE INVENTION

Field of the Invention

The present invention relates to a Bluetooth neck band headset including a vibration speaker, and more specifically, to a Bluetooth neck band headset including a vibration speaker capable of simultaneously embodying sound output and high-power vibration.

Description of the Related Art

The speaker is a device for converting an electrical energy applied to a voice coil existed between air gaps of magnetic circuit to a mechanical energy according to Fleming's left-hand law in that the current-carrying conductor receives a power when it is existed in a magnetic field.

In other words, if current signals including various frequencies are applied to the voice coil, the voice coil generates the mechanical energy, depending on the strength of the current and the size of the frequency and the diaphragm, which is attached to the voice coil, is vibrated up and down, so that it can generate the sound pressure perceptible to human ears.

In the speaker, the magnetic circuit is formed by using a magnet and an upper plate inside a yoke and the voice coil is formed inside the air gaps for the interlikage of magnetic flux of the magnetic circuit. Also since the voice coil is attached to the diaphragm, the electromotive force is generated up and down by means of the input signals applied to the voice coil, so that the diaphragm bonded and restricted to a frame is vibrated, thereby generating the sound pressure.

The speaker includes the frame having an opened upper portion and an install space therein. The frame includes one stepped portion bonded to an edge and another stepped portion bonded to an outer section of the suspension up and down respectively. The diaphragm is naturally vibrated up and down through the edge. The current is applied to the diaphragm from outside and the voice coil capable of vibrating up and down by means of the electromagnetic force with the magnet is attached to the diaphragm. Generally, the size and shape of the speaker depends on the size and shape of the frame. These technologies are disclosed in Patent Literature 1 and Patent Literature 2.

The Patent Literature 1 relates to a speaker, in which sound quality can be improved by suppressing division resonance, including a frame; a magnetic circuit unit coupled to the frame and configured to generate a magnetic force; a voice coil provided in the frame and configured to vibrate according to the magnetic force; a diaphragm configured to vibrate and produce sound in response to the vibration of the voice coil; and an edge unit that connects the diaphragm and the frame, wherein the edge unit includes a first edge provided between the diaphragm and the frame and configured to control vibration of the diaphragm; and a second edge provided under the first edge.

The Patent Literature 2 includes a speaker frame, an edge, and a cone body. A sound generation unit is arranged in the inside of the speaker frame; the edge is arranged at a rim of the speaker frame; and the cone body is arranged in a front side of the speaker frame and is fixed to the speaker frame by means of the edge. A reinforcing rib is formed along a rim of the cone body. The cone body is arranged to cover the edge and is processed by using a glossy material. Accordingly, the speaker is provided to improve freedom degree of design and to prevent the damage of the edge by shielding the edge outside the speaker.

However, in the conventional speakers including the Patent Literature 1 and the Patent Literature 2, since it lacks the vibration strength, it is difficult to realize the output of the sound and the vibration strength at the same time. Accordingly, there is an inconvenience in that it is necessary to equip the speaker module and the vibration module separately without a good use of the vibration generated by the speaker module.

PATENT LITERATURE

Patent Literature 1: Korean Patent Publication No. 10-2016-0034003 (Mar. 29, 2016)

Patent Literature 2: Korean Patent Registration No. 10-1258293 (Apr. 19, 2013)

SUMMARY OF THE INVENTION

The present invention has been made in an effort to solve the problems of the conceptual description of the conventional art as described above, and the objective of the present invention is to provide a Bluetooth neck band headset including a vibration speaker capable of simultaneously embodying sound output and high-power vibration.

Also, another objective of the present invention is to provide a Bluetooth neck band headset including a vibration speaker capable of embodying high-power vibration force.

Moreover, further another objective of the present invention is to provide a Bluetooth neck band headset including a vibration speaker, which prevents a magnetic circuit from vibrating left and right by high-power vibration to prevent a coil and components in the magnetic circuit from coming in contact with each other, thereby stably embodying vibration force.

According to an aspect of the invention to achieve the object described above, there is provided a Bluetooth neck band headset including a vibration speaker, in a Bluetooth neck band which communicates with a terminal of a user by interworking with the terminal of the user, including:

a tube frame (100) which maintains the shape of the neck band, and stably surrounds a neck circumference of a user;

base frames (200) which are provided on one side and the other side of the tube frame (100), form the shape of the neck band, and are stably placed on left and right clavicles of the user when the user wears the Bluetooth neck band headset;

a Bluetooth module which is provided in the base frame (200), and performs two-way data communication by interworking with the terminal of the user;

a vibration speaker (300) which is provided on one surface of each base frame (200), and simultaneously embody sound output and vibration power;

an earphone (400) which is coupled to one side of each base frame (200), and outputs sound;

a control module (800) which is provided in the base frame (200), and controls any one or more of the vibration speaker (300), the earphone (400), and the Bluetooth module;

a power button (500) which is provided on one surface of the base frame (200), and controls ON/OFF of power; and a volume button (600) which is provided on one surface of the base frame (200), and controls the intensity of sound output of any one or more of the earphone (400) and the vibration speaker (300).

ADVANTAGEOUS EFFECTS

Accordingly, the present invention has an effect capable of providing the Bluetooth neck band headset including a vibration speaker capable of simultaneously embodying the sound output and the high-power vibration.

Also, the present invention has another effect capable of providing the Bluetooth neck band headset including the vibration speaker capable of embodying high-power vibration force.

Moreover, the present invention has another effect capable of providing the Bluetooth neck band headset including the vibration speaker, which prevents the magnetic circuit from vibrating left and right by high-power vibration to prevent the coil and the components in the magnetic circuit from coming in contact with each other, thereby stably embodying vibration force.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENT

Figure 1:
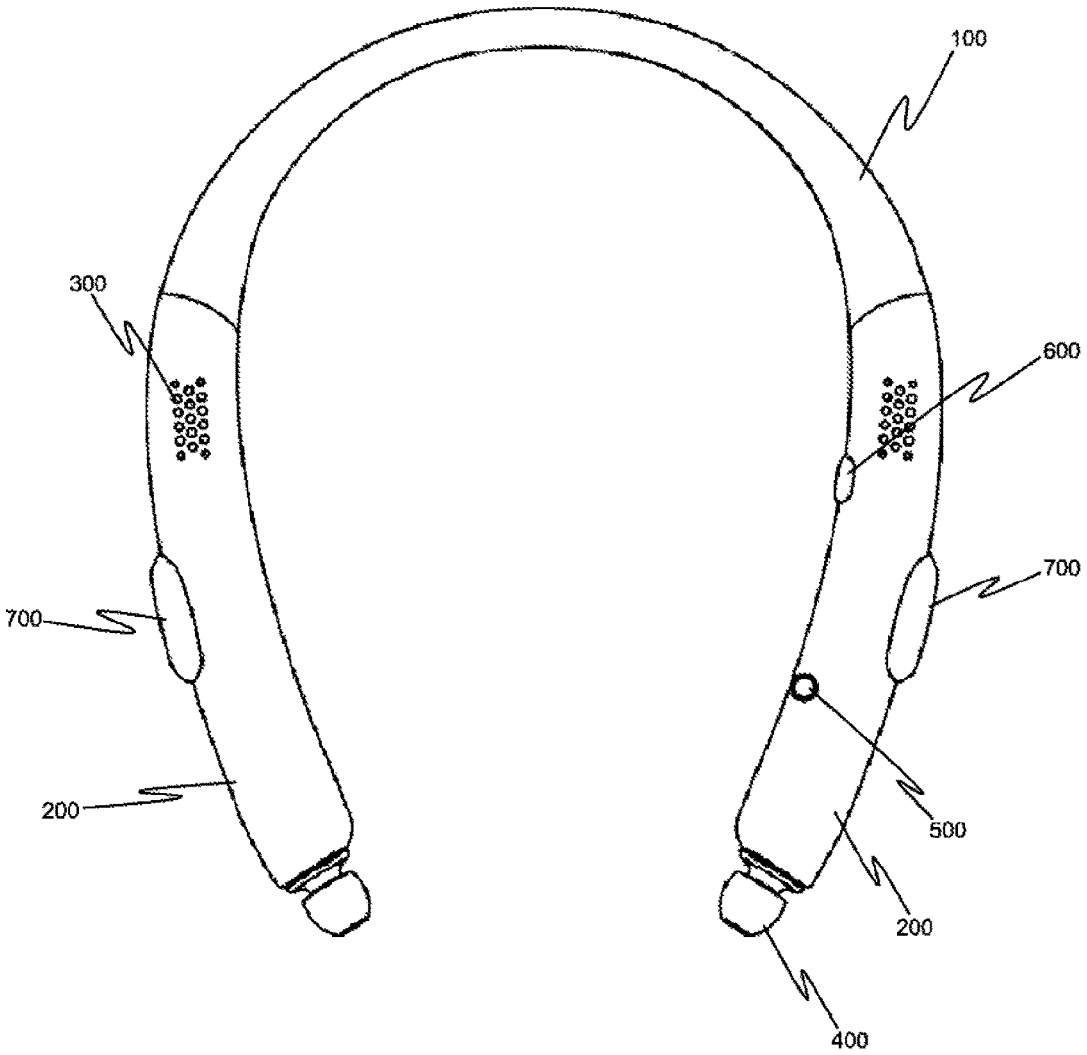
FIG. 1 is an entire perspective view illustrating a Bluetooth neck band headset including a vibration speaker according to an embodiment of the invention.

Hereinafter, the invention may be variously modified and may have various embodiments, and specific embodiments are exemplified in the drawings and described in detail. However, the invention is not limited to specific embodiments, and it should be understood that the invention includes all modifications, equivalents, and substitutes included within the spirit and technical scope of the invention. The embodiments are provided to describe the invention in more detail to persons skilled in the art. Accordingly, the shape of each element illustrated in the drawings may be exaggerated to emphasize more obvious description and, when it is determined that specific description about the related art may blur the gist of the invention, detailed description thereof is omitted.

Hereinafter, preferred embodiments of the invention will be described in more detail with reference to the accompanying drawings.

Referring to FIG. 1, in the invention according to a configuration example, a Bluetooth neck band headset including a vibration speaker, in a Bluetooth neck band which communicates with a terminal of a user by interworking with the terminal of the user, includes:

a tube frame (100) which maintains the shape of the neck band, and stably surrounds a neck circumference of a user;

base frames (200) which are provided on one side and the other side of the tube frame (100), form the shape of the neck band, and are stably placed on left and right clavicles of the user when the user wears the Bluetooth neck band headset;

a Bluetooth module which is provided in the base frame (200), and performs two-way data communication by interworking with the terminal of the user;

a vibration speaker (300) which is provided on one surface of each base frame (200), and simultaneously embody sound output and vibration power;

an earphone (400) which is coupled to one side of each base frame (200), and outputs sound;

a control module (800) which is provided in the base frame (200), and controls any one or more of the vibration speaker (300), the earphone (400), and the Bluetooth module;

a power button (500) which is provided on one surface of the base frame (200), and controls ON/OFF of power; and a volume button (600) which is provided on one surface of the base frame (200), and controls the intensity of sound output of any one or more of the earphone (400) and the vibration speaker (300).

In this case, the Bluetooth neck band headset further includes a rolling module which is provided in the base frame (200), and when the earphone (400) is uncoupled from the base frame (200), rolls up a wire of the earphone (400) such that the base frame (200) is coupled to the earphone (400).

In addition, the Bluetooth neck band headset further includes a rolling button (700), which controls ON/OFF of the rolling module, and is provided on one side of the base frame (200).

Figure 2:
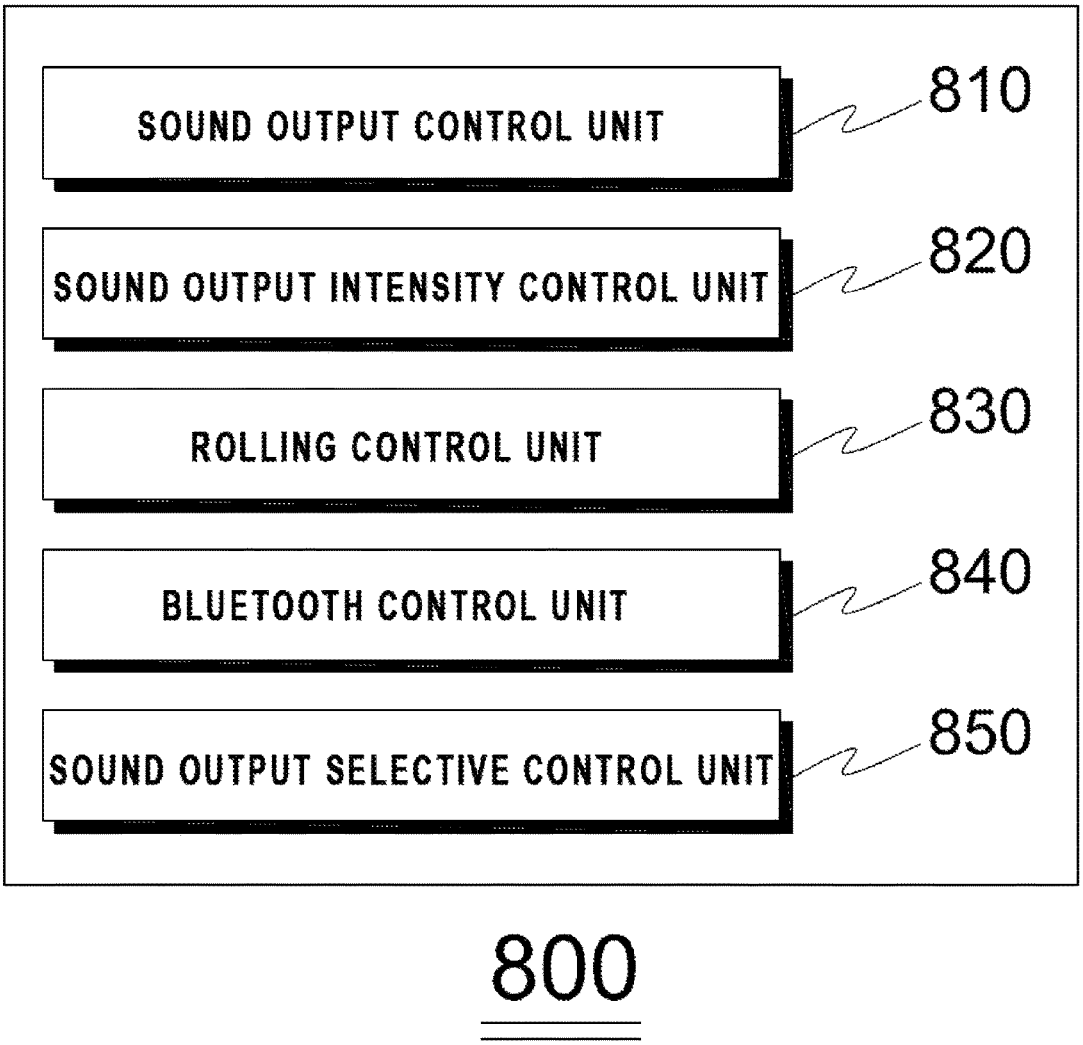
FIG. 2 is a block diagram illustrating a configuration of a control module (800) of a Bluetooth neck band headset including a vibration speaker according to an embodiment of the invention.

FIG. 2 is a diagram illustrating a configuration of a control module (800) according to a configuration example of the invention.

Referring to FIG. 2, the control module (800) of the invention includes:

a sound output control unit (810) which acquires sound information transmitted from a terminal of a user, from the Bluetooth module, and transmits the acquired sound information to any one or more of the earphone (400) and the vibration speaker (300) to output the sound information; and a sound output intensity control unit (820) which acquires an operation signal of the volume button (600), and controls a sound output intensity of any one or more of the earphone (400) and the vibration speaker (300) by using the acquired operation signal.

In this case, the control module (800) further includes a rolling control unit (830) which acquires an operation signal of the rolling button (700), and transmits a control signal to the rolling module to control ON/OFF of the rolling module by using the acquired operation signal.

In addition, the control module (800) further includes a Bluetooth control unit (840) which acquires an operation signal of the power button (500), and controls ON/OFF of the Bluetooth module by using the acquired operation signal.

In addition, the control module (800) further includes a sound output selective control unit (850) which acquires an operation signal of the power button (500), and controls any one or more of the vibration speaker (300) and the earphone (400) to control sound output by using the acquired operation signal.

This means that the sound information acquired by the Bluetooth module is controlled to be output from any one of the vibration speaker (300) and the earphone (400) by using an operation signal (500), or is controlled to be output from both of the earphone (400) and the vibration speaker (300).

Figure 3:
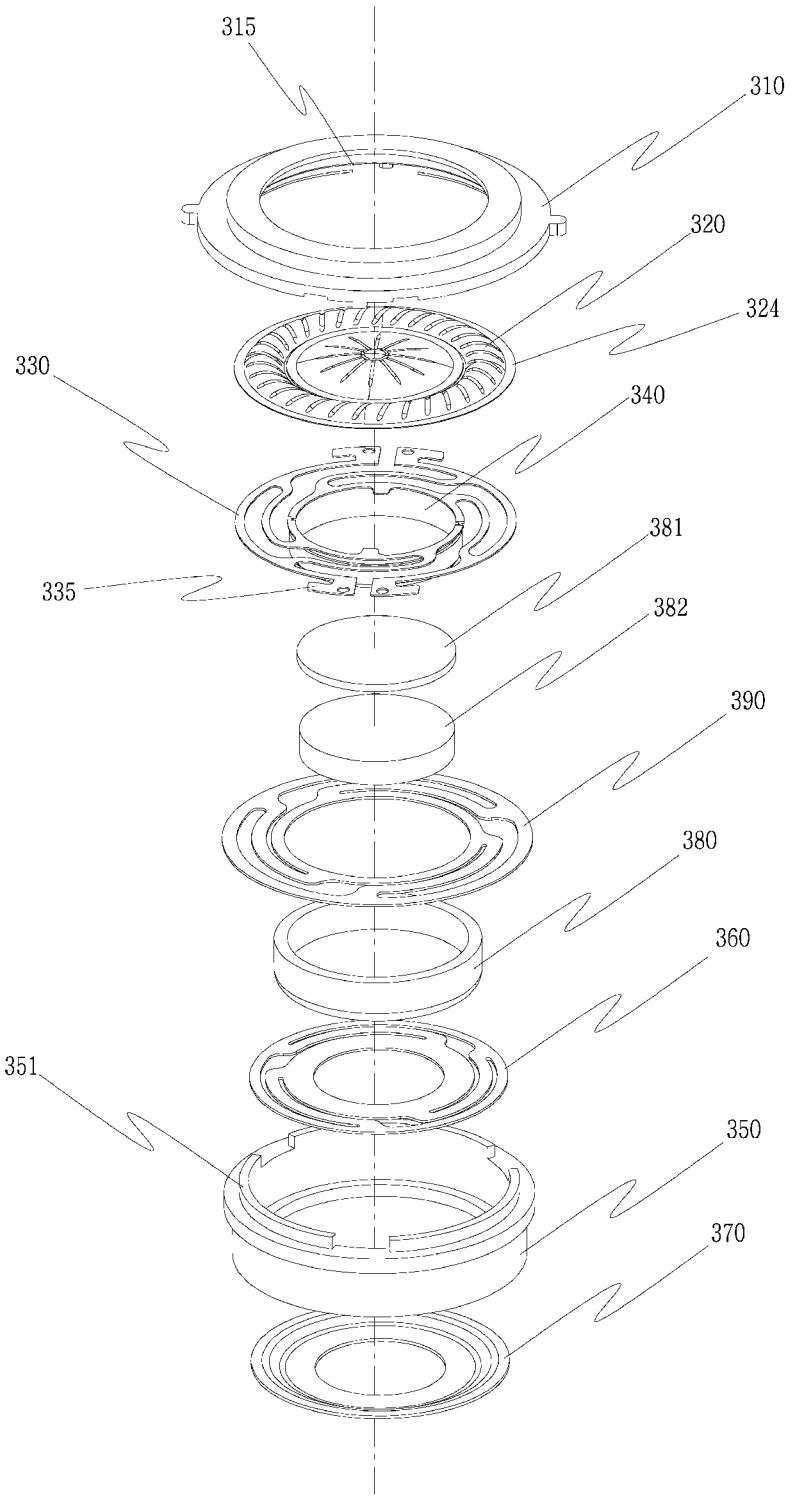
FIG. 3 is an exploded perspective view illustrating a configuration example of a vibration speaker of a Bluetooth neck band headset including a vibration speaker according to an embodiment of the invention the invention.

FIG. 3 is an exploded perspective view illustrating a configuration example of the vibration speaker (300) of the invention.

Figure 4:
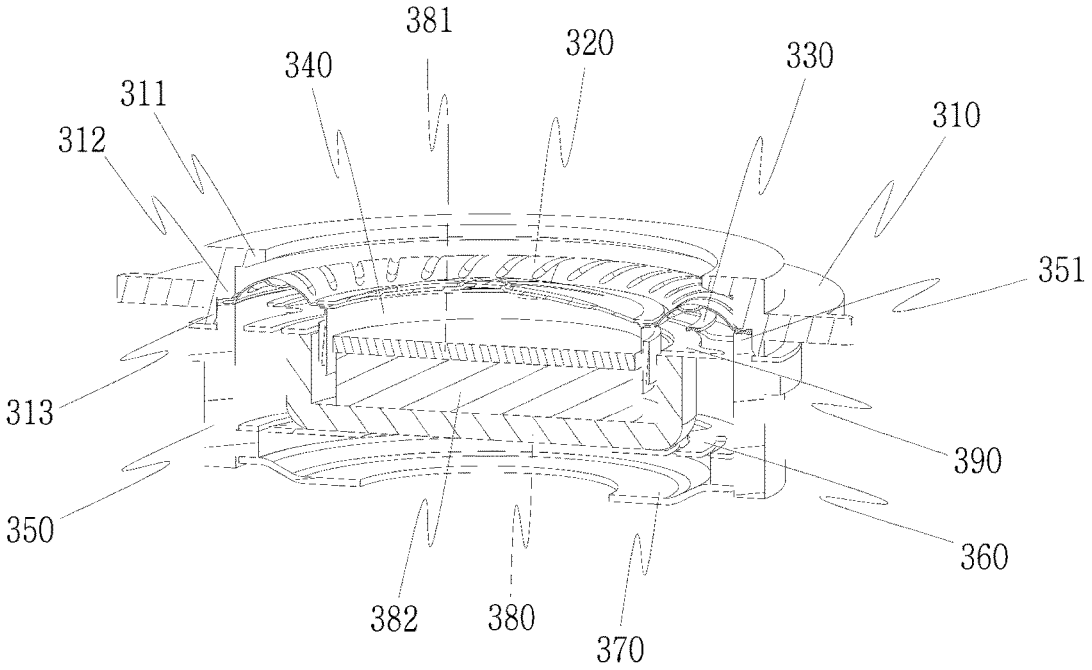
FIG. 4 is a cross-sectional perspective view illustrating a coupling state of a vibration speaker of a Bluetooth neck band headset including a vibration speaker according to an embodiment of the invention.

FIG. 4 is a cross-sectional perspective view illustrating a coupling state according to a configuration of the vibration speaker (300) of the invention.

Referring to FIG. 3 and FIG. 4, the vibration speaker (300) of the invention includes:

a cap (310) which is provided with a hollow at the center thereof;

a first suspension (330) which is fixed to the middle portion of the inner circumference of the cap (100);

a vibration plate (320) which is positioned between the cap (100) and the first suspension (330);

a coil (340) which is fixed to the lower portion of the first suspension (330);

a frame (350) which is coupled to the lower portion of the cap (310);

a yoke (380) which has an opened upper portion, and fixes the outer circumference of the outside of the upper portion to the inner circumference of the frame (350) in close contact;

a magnet (382) which is fixed to the bottom in the yoke (380);

a plate (381) which is fixed to the upper portion of the magnet (382);

a second suspension (360) which is fixed to the lower portion of the yoke (380);

a grill (370) which is coupled to the lower portion of the frame (350); and a third suspension (390) which is fixed to the upper portion of the yoke (380).

The cap (310) is provided with a hollow at the center thereof, and the hollow center is configured such that the center of the vibration plate (320) is exposed through the hollow center of the cap (310) when the vibration plate (320) is fixed to the upper portion of the inner circumference of the cap (310) together with the first suspension (330).

The cap (310) is formed with the upper portion of the inner circumference, the middle portion of the inner circumference, and the lower portion of the inner circumference having diameter different from each other, an 'L'-shaped first step portion (311) is formed at the upper portion of the inner circumference, an 'L'-shaped second step portion (312) is formed at the middle portion of the inner circumference, an 'L'-shaped third step portion (313) is formed at the lower portion of the inner circumference, and preferably, the diameters of the inner circumference are gradually increased from the upper portion to the lower portion.

The cap (310) may further include one or more first suspension fitting grooves (315) capable of coupling the first suspension (330) at the middle portion of the inner circumference.

The first suspension (330) is fixed to the middle portion of the inner circumference of the cap (310), and couples the frame (350) to the lower portion of the cap (310) in a state where the outer plane of the first suspension (330) comes in contact with the lower surface of the second step portion (312), such that the third step portion (313) is fitted and coupled to the frame (350), thereby fixing the circumference of the first suspension (330) between the cap (310) and the frame (350).

In this case, the first suspension (330) may further include one or more first suspension protrusions (335) protruding to the outside of the first suspension (330), to be fitted and coupled to the first suspension fitting grooves (315).

The vibration plate (320) is positioned between the cap (310) and the first suspension (330), and couples the cap (310) to the first suspension (330) in a state where the vibration plate (320) is stacked on the first suspension (330), at the time of coupling the cap (310) to the first suspension (330), such that the circumference of the vibration plate (320) is overlapped between the first suspension (330) and the cap (310).

In this case, the vibration plate (320) may further include one or more vibration plate fitting protrusions (324) protruding to the outside of the vibration plate (320).

The coil (340) is coupled to the lower portion of the first suspension (330).

The frame (350) is coupled to the lower portion of the cap (310), includes a suspension fitting protrusion (351) at the upper portion of the frame (350), and preferably forms a diameter to fit and couple the upper outer circumference of the suspension fitting protrusion (351) to come in contact with the inner circumference between the second step portion (312) and the third step portion (313) of the cap (310).

The frame (350) may include the suspension fitting protrusion (351) formed at the upper portion of the frame (350), to fit, couple, and fix the third suspension (390) to the upper portion of the frame (350).

The yoke (380) is provided with an opened upper portion, and is fixed by bringing the outer circumference of the upper outside in contact with the inner circumference of the frame (350).

The magnet (382) is fixed to the inner bottom of the yoke (380), and may be fixed by welding or adhering through an adhesive.

The plate (381) is fixed to the upper portion of the magnet (382), and may be fixed by welding or adhering through an adhesive.

The second suspension (360) is fixed to the lower portion of the yoke (380), and may be fixed to the lower portion of the yoke (380) by welding or adhering through an adhesive.

The third suspension (390) is fixed to the upper portion of the yoke (380), and may be fixed to the upper portion of the yoke (380) by welding or adhering through an adhesive.

The third suspension (390) may be fitted and coupled to the suspension fitting protrusion (351).

The grill (370) is coupled to the lower portion of the frame (350).

Accordingly, a P-type magnetic circuit provided with a magnetic circuit in a yoke is formed, and it is possible to maximize vibration force of up/down vibration of the magnetic circuit through the weight of the magnetic circuit and a plurality of suspension dampers during the forming of the current, so that it can provide the Bluetooth neck band headset including the vibration speaker capable of simultaneously embodying sound output and high-power vibration and embodying high-power vibration force. Also, it can provide the Bluetooth neck band headset including the vibration speaker, which prevents a magnetic circuit from vibrating left and right by high-power vibration to prevent a coil and components in the magnetic circuit from coming in contact with each other, thereby stably embodying vibration force.

While the present invention has been described with respect to the specific embodiments, it will be apparent to those skilled in the art that various changes and modifications may be made without departing from the spirit and scope of the invention as defined in the following claims.

INDUSTRIAL APPLICABILITY

Accordingly, since the present invention can provide the Bluetooth neck band headset including the vibration speaker capable of simultaneously embodying the sound output and the high-power vibration; provide the Bluetooth neck band headset including the vibration speaker capable of embodying high-power vibration force; and can provide the Bluetooth neck band headset including the vibration speaker, which prevents the magnetic circuit from vibrating left and right by high-power vibration to prevent the coil and the components in the magnetic circuit from coming in contact with each other, thereby stably embodying vibration force, it can be widely used in industry.

REFERENCE SIGNS LIST

100: tube frame
200: base frame
300: vibration speaker
400: earphone
500: power button
600: volume button
700: rolling button
800: control module

What is claimed is:

1. A Bluetooth neck band headset comprising:
a tube frame forming a neck band and configured to surround a neck circumference of a user;
base frames which are provided at both ends of the tube frame;
a Bluetooth module which is provided in the base frame and performs two-way data communication by interworking with a terminal of the user;
a vibration speaker which is provided at each of the base frames and configured to output sound and vibration;
an earphone which is placed at an end of said each of the base frames to output sound;
a control module which controls any one or more of the vibration speaker, the earphone, and the Bluetooth module;
a power button which is provided at a first place of the base frames and controls ON/OFF of power; and
a volume button which is provided at a second place of the base frames and controls a volume of the sound of any one or more of the earphone and the vibration speaker,
wherein the vibration speaker comprises
a cap provided with a hole at a center thereof,
a first suspension fixed to a middle portion of an inner circumference of the cap,
a vibration plate positioned between the cap and the first suspension,
a coil fixed to a lower portion of the first suspension,
a frame coupled to a lower portion of the cap,
a yoke having an opened upper portion, wherein an outer circumference of an upper portion of the yoke is fixed to an inner circumference of the frame,
a magnet fixed to a bottom in the yoke,
a plate fixed to an upper portion of the magnet,
a second suspension fixed to a lower portion of the yoke, and
a grill coupled to a lower portion of the frame.

2. The Bluetooth neck band headset as claimed in claim 1, wherein the control module comprises:
a sound output control unit which acquires sound information transmitted from the terminal of the user through the Bluetooth module, and transmits the acquired sound information to any one or more of the earphone and the vibration speaker to output the sound information; and
a sound output intensity control unit which acquires an operation signal of the volume button, and controls the volume of the sound of any one or more of the earphone and the vibration speaker by using the acquired operation signal.

3. The Bluetooth neck band headset as claimed in claim 1, wherein the vibration speaker further comprises
a third suspension which is fixed to the upper portion of the yoke.

4. The Bluetooth neck band headset as claimed in claim 3, wherein the frame comprises a suspension fitting protrusion formed at an upper portion of the frame to fit, couple, and fix the third suspension to the upper portion of the frame.

5. The Bluetooth neck band headset as claimed in claim 1, wherein the cap comprises:
a first step portion formed at an upper portion of the inner circumference thereof;
a second step portion formed at a middle portion of the inner circumference thereof;
a third step portion formed at a lower portion of the inner circumference thereof; and
one or more first suspension fitting grooves capable of coupling the first suspension at the middle portion of the inner circumference thereof.

6. The Bluetooth neck band headset as claimed in claim 5, wherein the first suspension comprises first suspension protrusions coupled to the first suspension fitting grooves.

* * * * *